US006045253A

United States Patent [19]

Sullivan

[11] Patent Number: 6,045,253

[45] Date of Patent: Apr. 4, 2000

[54] RECIPROCAL MEMBER FOR MIXING THE CONTENTS OF A CONTAINER AND A DRIVE UNIT THEREFOR

[75] Inventor: Barry Sullivan, Houghton Conquest, United Kingdom

[73] Assignee: BHR Group Limited, United Kingdom

[21] Appl. No.: 09/091,007

[22] PCT Filed: Dec. 9, 1996

[86] PCT No.: PCT/GB96/03021

§ 371 Date: Jun. 8, 1998

§ 102(e) Date: Jun. 8, 1998

[87] PCT Pub. No.: WO97/21486

PCT Pub. Date: Jun. 19, 1997

[30] Foreign Application Priority Data

Dec. 8, 1995 [GB] United Kingdom ..... 9525184

[51] Int. Cl.[7] ..... B01F 11/00

[52] U.S. Cl. ..... 366/113; 366/205; 366/206; 366/333

[58] Field of Search ..... 366/110–114, 128, 366/197, 203, 205, 208, 209, 212, 206, 332–335

[56] References Cited

U.S. PATENT DOCUMENTS

| | | | |
|---|---|---|---|
| 1,437,880 | 12/1922 | Baker | 366/111 |
| 2,235,942 | 3/1941 | Moore | 366/110 |
| 2,356,004 | 8/1944 | Price | 366/110 |
| 2,363,937 | 11/1944 | Brandt et al. | 366/114 |
| 2,462,286 | 2/1949 | Rhodes | 366/111 |
| 3,132,848 | 5/1964 | Garlinghouse . | |
| 3,211,432 | 10/1965 | Van Rossem | 366/112 |
| 3,595,530 | 7/1971 | Hubers | 366/332 |
| 3,740,028 | 6/1973 | Bodine | 366/114 |
| 3,833,203 | 9/1974 | Garlinghouse | 366/113 |
| 4,151,982 | 5/1979 | Herz | 366/114 |
| 4,198,166 | 4/1980 | Tuns | 366/112 |

FOREIGN PATENT DOCUMENTS

| | | | |
|---|---|---|---|
| 560885 | 10/1932 | Germany | 366/110 |
| 746279 | 3/1956 | United Kingdom . | |
| 834052 | 5/1960 | United Kingdom . | |
| 2 298 146 | 8/1996 | United Kingdom . | |

*Primary Examiner*—Charles E. Cooley
*Attorney, Agent, or Firm*—Larson & Taylor

[57] ABSTRACT

A member within a container is reciprocated to vibrate the container contents. A drive unit is releasably connectable to the reciprocating member so that the drive unit can be used for other purposes, such as for driving the reciprocal members of other containers when not required for the container in question. The drive unit comprises a reciprocal output member with a releasable mechanism for drivably connecting the output member with the reciprocal member of the container and a device for removably mounting the container on the drive unit.

9 Claims, 2 Drawing Sheets

RECIPROCAL MEMBER FOR MIXING THE CONTENTS OF A CONTAINER AND A DRIVE UNIT THEREFOR

FIELD OF THE INVENTION

This invention relates to a container mixing device in which the container is provided with a reciprocable member for applying vibrations to the contents of the container, the device further comprising means for reciprocating the member.

BACKGROUND OF THE INVENTION

In situations where the contents of the container are only required to be mixed at infrequent intervals, the provision of a prime mover exclusively used for reciprocating the member is an inefficient arrangement.

SUMMARY OF THE INVENTION

U.S. Pat. No. 3,132,848 discloses a container mixing device comprising a container having a reciprocable member communicating with its interior to effect mixing and a drive unit comprising a reciprocable output member, means for drivably connecting the output member with the reciprocable member of the container and means for removably mounting the container on the drive unit. The present invention provides a drivably connecting means which is releasable. The reciprocable output member remains with the drive unit and separate reciprocable output members do not have to be provided for respective containers.

The present invention provides a drive unit which can be releasably connected to the reciprocable member so that the drive unit can be used for other purposes, such as for driving the reciprocable members of other containers, when not required for the container in question. The invention as presently envisaged as a container mixing device comprising a container having a reciprocable member communicating with its interior and a drive unit comprising a reciprocable output member, releasable means for drivably connecting the output member with the reciprocable member of the container and means for removably mounting the container on the drive unit.

The container reciprocable member may comprise a cam and cam follower and the drivably connecting means may comprise means connecting to the cam follower. The container reciprocable member may comprise a pin and the drivably connecting means then comprises means mounted on the reciprocable output member for engaging the pin. The engaging means may comprise a jaw for receiving the pin and resilient means for retaining the pin within the jaw.

The drive unit may comprise a motor having a drive shaft and the reciprocable output member may comprise a cylinder mounted eccentrically on said shaft. The container reciprocable member may comprise a cam follower having a concave cam follower surface matching the cylindrical cam surface.

The means for removably mounting the container on the drive unit may comprise means for supporting the container spaced from the floor when the drive means is on the floor. The container mounting means may comprise means for sensing the presence thereon of the container for controlling the operation of the drive unit. The container may comprise a base, the reciprocable member extending through the base to the interior of the container, the container comprising a plate mounted on the reciprocable member within the interior of the container and a flexible liner to isolate the plate from the contents of the container to be mixed. The flexible liner may be secured to the walls of the container around the plate.

BRIEF DESCRIPTION OF THE DRAWINGS

An example of the invention will now be described with reference to the accompanying drawings in which.

DETAILED DESCRIPTION OF THE PREFERRED EMBODIMENTS

Figure 1:
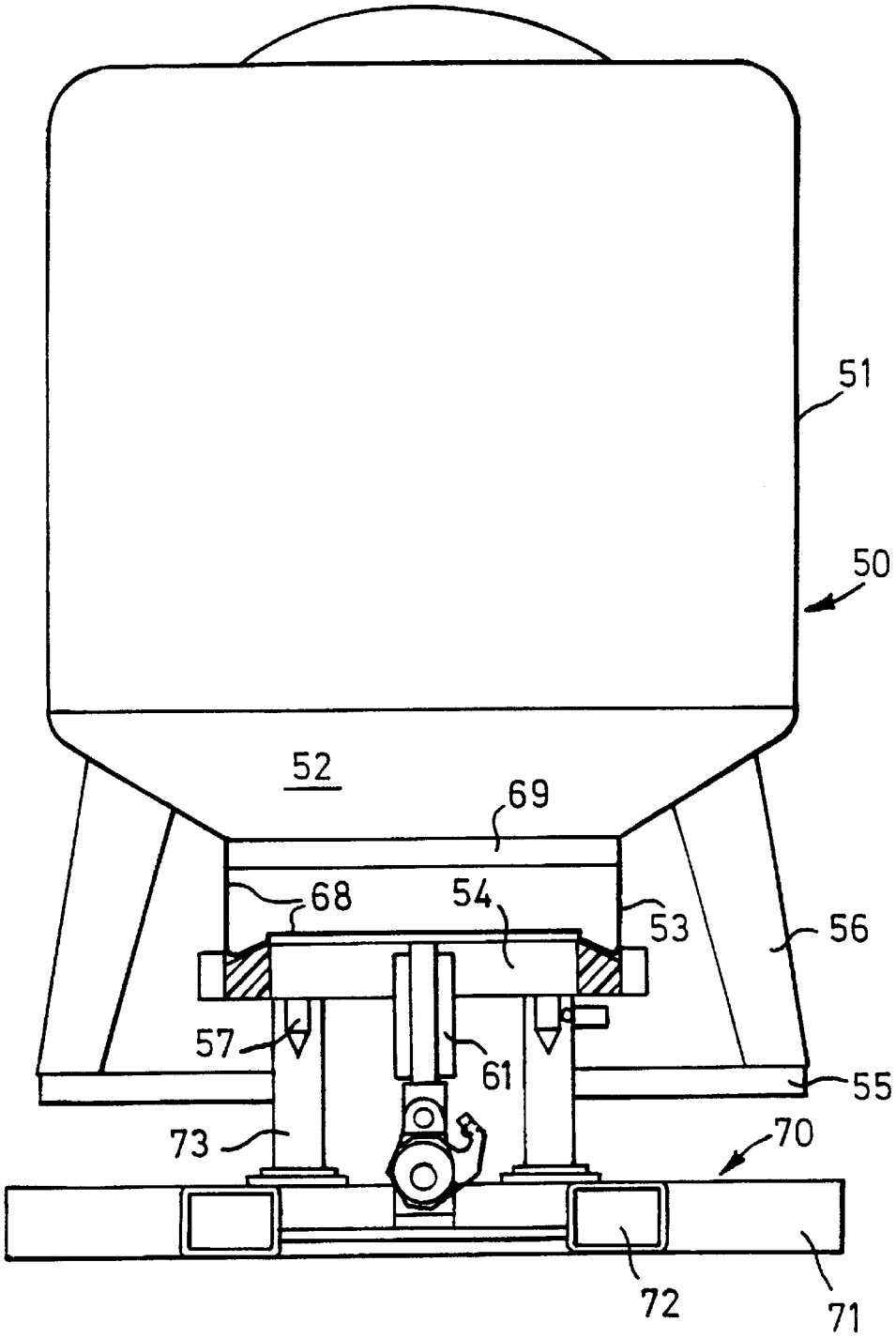
FIG. 1 is a side elevation of a container mounted on a driving device, partly in section.
Figure 2:
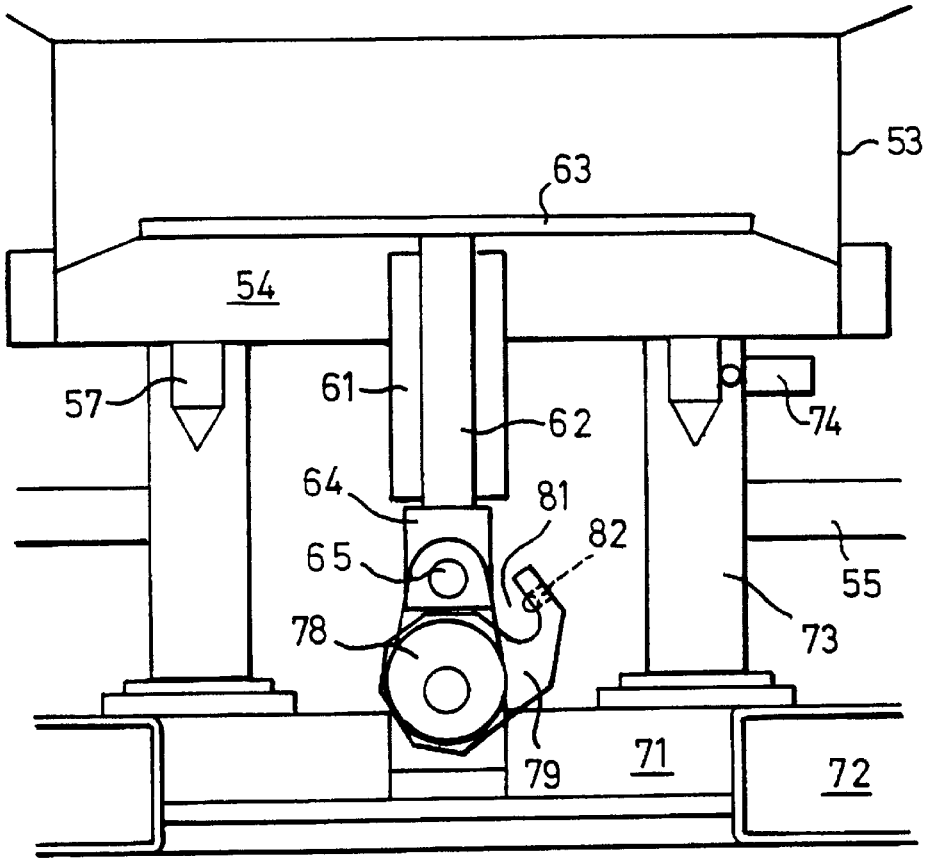
FIG. 2 shows the lower part of the side elevation of FIG. 1 on an enlarged scale and without the sectional parts.

The assembly shown in FIG. 1 is a standard container 50 mounted on top of a driving device 70. The container 50 has a generally cubic upper chamber 51 with a converging base 52 leading to a funnel outlet 53 closed by a lower plug 54. A base ring 55 is secured to the converging base 52 by legs 56 so that the container can be parked with the base ring 55 resting on the ground and the funnel outlet 53 clear of the ground. Around the periphery of the funnel outlet 53 are four depending pins 57 whose purpose will be described later.

A sleeve 61 is mounted by means not shown in the drawing to depend below the plug 54, the sleeve forming a bearing for a reciprocable vertical shaft 62 on the top of which is mounted a plate 63. At the bottom of the shaft 62 is a shackle 64 across the arms of which is mounted a pin 65. Cam follower member 66 is mounted on the pin between the arms of the shackle, the member having a lower cam follower surface which is concave and cylindrical.

As can be seen in FIG. 1, the funnel 53 and plug 54 of the container are lined with a flexible liner 68 which extends down the sides of the funnel, across the upwardly inclined top surface of the rim of the plug 54 and over the upper surface of the plate 63. The top edges of the liner 68 are secured by a diode plate 69 against the walls of the funnel and this diode plate may be of the form described in EP-A-0 123 452.

The drive unit 70 has a generally rectangular framework 71 which rests on the floor, provided with parallel hollow passages 72 adapted to receive the forks of a lift truck. There are four upwardly directed columns 73 which receive the four pins 57 of the container, and the top of one column is provided with a sensor switch 74 which senses the presence of a pin 57 to control the energization of the drive unit.

Figure 3:
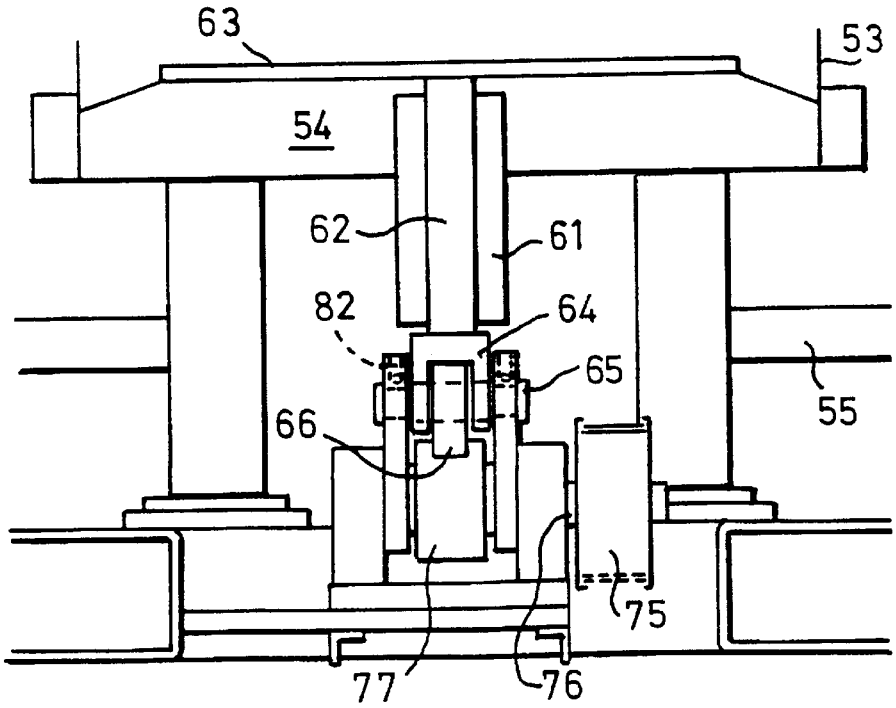
FIG. 3 is a front elevation to the same scale as FIG. 2 of the container of FIG. 1.

Mounted on the framework 71 is a motor 75 driving an output shaft 76 extending transversely, parallel to the pin 65 of the container. Mounted on the shaft aligned with the cam follower 66 and the axis of the vertical shaft 62 is an eccentric 77 whose radius matches that of the concave cam follower surface of the cam follower 66. The eccentric is a cylinder whose axis is displaced from but parallel to the axis of the motor drive shaft 76. A further cylinder 78 is mounted coaxially with the eccentric on each side thereof having rotatably mounted about its circumference a claw member 79 as can best be seen in FIG. 3. The claw member can be rotated about the further cylinder 78 from the position shown in FIG. 3 to a position in which the mouth 81 of the claw envelops the pin. The claw mouth has a spring-loaded plunger 82 which secures the claw member 79 on the pin 65 in a releasable manner. The motor 75 drives the eccentric in an anti-clockwise direction as seen in FIG. 3 so that the claw member is urged into engagement with the pin; there is no tendency for the claw member to become detached from the pin during operation of the motor.

The claw members 79 engage the pin 65 so that vertical reciprocation of the axis of the eccentric 77 when the motor is energised is transferred to the pin 65 and thence to the plate in the interior of the container. The vibrations of the plate are transmitted through the liner 68 to the contents of the container to mix them, with the assistance of the diode plate 69 if provided. The liner serves to isolate the container contents from the reciprocating plate 63 to avoid it and its bearings becoming contaminated by the contents of the container.

When the container 50 is used for storage, it can be parked on the ground with its base ring 55 in contact with the ground. When it is desired to mix the contents of the container, the container 50 is lifted on to the drive unit 70 so that the pins 57 depending from the periphery of the plug enter the respective columns 73 on the drive unit. The switch 74 then energises the drive motor. This ensures that the drive unit 70 cannot be energized until a container 50 is mounted thereon.

As the container 50 is lowered on to the drive unit 70, the cam follower surface 66 will engage the periphery of the eccentric 77. The claw members 79 will have been placed in the position shown in FIG. 3 prior to the lowering of the container on to the drive unit and once the container is in position, the claw members can be moved manually into position so that the pin ends are engaged by the two claw members or the drive motor can be energized so that the friction between the further cylinders and the claw member will rotate the member into engagement with the pin. Once the claw members 79 are engaged with the pin they will be releasably held there by the plungers 82 and the vertical reciprocation of the cam is transmitted through the shaft to the plate.

When the mixing operation has been completed, the claw members 79 are disengaged and container 50 is lifted off the drive unit and can be parked elsewhere with its base ring 55 resting on the ground. If the mixed contents of the container are to be used immediately, the container may be parked over a delivery chute and the plug 54 removed from the base of the container to allow the contents to be delivered to the chute. It will be necessary to remove the flexible diaphragm and possibly the diode plate if provided as well to allow the contents to escape easily. A new container 50 can then be lifted into position on top of the drive unit 70 in its present position or the drive unit can be moved to a new location.

What is claimed is:

1. A container mixing device comprising a container having a reciprocable member comprising a pin communicating with its interior to effect mixing and a drive unit comprising a reciprocable output member, releasable means comprising means mounted on the reciprocable output member for engaging the pin whereby the output member is releasably connected with the reciprocable member of the container, and means for removably mounting the container on the drive unit.

2. A device as claimed in claim 1 wherein the reciprocable output member comprises a cam and the container reciprocable member comprises a cam follower and the reciprocable output member comprises means connecting to the cam follower when the container is mounted on the drive unit.

3. A device as claimed in claim 1 wherein the engaging means comprises a jaw for receiving the pin and resilient means for retaining the pin within the jaw.

4. A device as claimed in claim 1 wherein the drive unit comprises a motor having a drive shaft and the reciprocable output member comprises a cylinder mounted eccentrically on said shaft.

5. A device as claimed in claim 4 wherein the container reciprocable member comprises a cam follower having a concave cam follower surface matching said cylinder.

6. A device as claimed in claim 1 wherein the means for removably mounting the container on the drive unit comprises means for supporting the container spaced from the floor when the drive unit is on the floor.

7. A device as claimed in claim 1 wherein the container mounting means comprises means for sensing the presence thereon of the container for controlling the operation of the drive unit.

8. A container mixing device comprising a container comprising a base, the container having a reciprocal member extending through the base to an interior of the container, the container further comprising a plate mounted on the reciprocal member within the interior of the container and a flexible liner for isolating the plate from contents of the container to mixed, the container mixing device further comprising a drive unit comprising a reciprocal output member, releasable means for releasably connecting the output member with the reciprocal member of the container and means for removably mounting the container in the drive unit.

9. A device as claimed in claim 8 wherein the flexible liner is secured to the walls of the container around the plate.

* * * * *